22-23 SR
10/22/85 OR 4,548,351

United States Patent [19]
Gusic

[11] Patent Number: 4,548,351
[45] Date of Patent: Oct. 22, 1985

[54] REMOVABLE ACCESS DOOR ON BULK CONTAINER HAVING MULTIPLE LAYER WALLS

[76] Inventor: Perry Gusic, 3750 W. Main, Suite AA-4065, Norman, Okla. 73069

[21] Appl. No.: 603,530

[22] Filed: Apr. 25, 1984

Related U.S. Application Data

[63] Continuation-in-part of Ser. No. 410,215, Aug. 23, 1982, abandoned.

[51] Int. Cl.[4] ..... B65D 5/32
[52] U.S. Cl. ..... 229/23 R; 206/586; 220/441; 220/443; 222/105; 229/17 B
[58] Field of Search ..... 229/17 B, 17 SC, 7 SC, 229/7 R, 23 R, DIG. 4; 222/447, 559, 105; 206/44.12, 386, 586, 814; 220/416, 418, 441, 443

[56] References Cited

U.S. PATENT DOCUMENTS

| | | | |
|---|---|---|---|
| 1,973,930 | 9/1934 | Rammer | 229/DIG. 4 |
| 2,799,440 | 7/1957 | Frederich et al. | 229/17 B |
| 2,803,390 | 8/1957 | MacKay | 229/17 B |
| 2,831,610 | 4/1958 | Dennie | 222/105 |
| 3,021,044 | 2/1962 | Schubert | 229/17 B |
| 3,081,003 | 3/1963 | Baxter et al. | 222/105 |
| 3,172,570 | 3/1965 | Lipschutz | 222/105 |
| 3,193,152 | 7/1965 | White, Jr. | 229/17 B X |
| 3,357,628 | 12/1967 | Fish | 229/23 R |
| 3,744,702 | 7/1973 | Ellison | 229/23 R |
| 3,791,562 | 2/1974 | Bamburg et al. | 222/528 |
| 3,883,065 | 5/1975 | Presnick | 220/416 X |
| 3,904,105 | 9/1975 | Booth | 229/17 SC |
| 3,910,482 | 10/1975 | Bamburg et al. | 220/441 |
| 3,957,179 | 5/1976 | Bamburg et al. | 222/528 |
| 4,240,565 | 12/1980 | Croley | 222/105 |

*Primary Examiner*—William Price
*Assistant Examiner*—Gary E. Elkins
*Attorney, Agent, or Firm*—Robert K. Rhea

[57] ABSTRACT

A double wall corrugated bulk material shipping container is provided with a dispensing opening in the depending end portion of one of its walls. Intersecting edge surfaces of the wall forming the dispensing opening are formed on a radius to prevent rupture of the container wall by the mass of contained bulk material when the opening is uncovered. The opening is covered and the container wall surface surrounding the opening is shielded from contamination during shipping or storage by a removable door cover overlapping the container wall having the opening and adjacent surfaces of adjoining walls. The door cover is maintained in place by container surrounding bands.

4 Claims, 5 Drawing Figures

14
16
18
22
32
33
34
35
36
37
38
39
40
41
42
43
44
45
46
47
48
49
50
51
52
53
54
55
56
57
58
59
60
61
62
63
64
65
68
69
71
82
86
88
90
92

REMOVABLE ACCESS DOOR ON BULK CONTAINER HAVING MULTIPLE LAYER WALLS

This application is a continuation-in-part of an application filed by me in the U.S. Patent and Trademark Office for BULK MATERIAL CONTAINER on Aug. 23, 1982, Ser. No. 410,215, now abandoned.

BACKGROUND OF THE INVENTION

1. Field of the invention

The present invention relates to bulk material containers and more particularly to a container for shipping, storing and dispensing bulk material from a container having a recloseable dispensing opening formed in one of its walls.

Large size containers formed from lightweight panel material, such as corrugated board, for holding granular or powdered material generally do not provide sufficient rigidity for the container in order for two or more of the containers to be stored in superposed relation. These containers are usually formed with a cutout or panel closed opening adjacent the depending limit of one of its walls for dispensing the granular material, however, these openings are generally formed rectangular and are subject to failure of the container wall, as a result of the mass of the contained material, at one or more of the corners of the rectangular dispensing opening, particularly at the time the material is being dispensed from the container, which results in the necessity of discarding the container after a onetime use.

This invention provides rigidly constructed bulk materail containers permitting the containers to be filled with approximately one ton of powdered or granular material and superposed in storage or for shipping. Additionaly, the containers are provided with a dispensing opening in the depending end portion of one wall which is easily reclosed after emptying the container and which will not result in a rupture of the container wall edges defining the dispensing opening. Since the dispensing opening is opened and closed by a door cover, separate from the container structure, dispensing opening door flaps hingedly connnected with the container wall, are eliminated thus permitting the container to be emptied of bulk powdered material, such as flour, by an air pressure or vacuum system having an intake defined by a throat end wall surface contiguously contacting a container outer wall surface around a dispensing opening therein.

2. Description of the Prior Art

The most pertinent prior patent is believed to be U.S. Pat. No. 3,193,152 which discloses an upright polygonal container having a bottom opening in one of its walls and a bottom tray in which a plurality of overlapping and folding door panels interposed between container walls are manually opened outwardly in a hinging action to provide a pouring spout which may be refolded to a closed position.

This invention is distinctive over this patent by providing an upright container having a dispensing opening formed in the depending end portion of one of its walls closed by a door cover overlapping the outer surface of the container end wall surrounding the door opening and adjacent edge portions of the adjacent container side walls as opposed to interposing the door cover between the container walls. The purpose of the overlapping door cover is to prevent contamination of the container wall around the dispensing opening that would be detrimental to contained edible food when discharged from the container. The door cover held in door opening closed position by straps surrounding the periphery of the container and the door cover.

SUMMARY OF THE INVENTION

The container is constructed from double thickness lightweight panel material, such as corrugated board, in which a pair of walls, each having a double thickness liner bonded thereto, are joined together to form a rectangular upright open end sleeve. One wall and liner of the sleeve is provided with a cutout forming a door opening at its depending end. The upper end of the sleeve is closed by a top cap flatly overlying the upper edge of its walls, the top cap having depending surrounding wall portions telescopically overlapping the upper edge portion of the sleeve walls. The top cap is characterized by a central normally closed access door for filling the container. A separable panel-like door cover, overlapping the outer surface of the sleeve wall having the dispensing opening therein, also overlaps adjacent vertical edge portions of the adjacent sleeve walls. The bottom end of the sleeve is closed by a bottom cap or tray having integral upstanding band-like walls telescopically overlapping the depending edge portions of the sleeve walls and door cover. A plurality of vertically spaced straps surround the sleeve and door cover to add rigidity to the container and maintain the dispensing opening closed.

The principal object of this invention is to provide a container formed from relatively lightweight panel material assembled in a manner to form a relatively rigid container for powdered or granulated bulk material having a dispensing door opened and closed by a door cover in which the wall edges defining the door opening are formed in a manner which prevents rupture of the sleeve wall at its edges defining the door opening and in which the door cover, by overlapping the outer surface of the sleeve wall around the door opening, prevents contamination of the sleeve wall around the opening and thus contamination of food during its removal from the container.

A further object is to provide a container in which a bulk material dispensing opening is opened by removing a door cover normally secured to the outer surface of the wall over the opening which eliminates any restriction of air flow in either direction through the dispensing opening when powdered bulk material is unloaded from the container by an air pressure or vacuum system.

DESCRIPTION OF THE PREFERRED EMBODIMENTS

Figure 1:
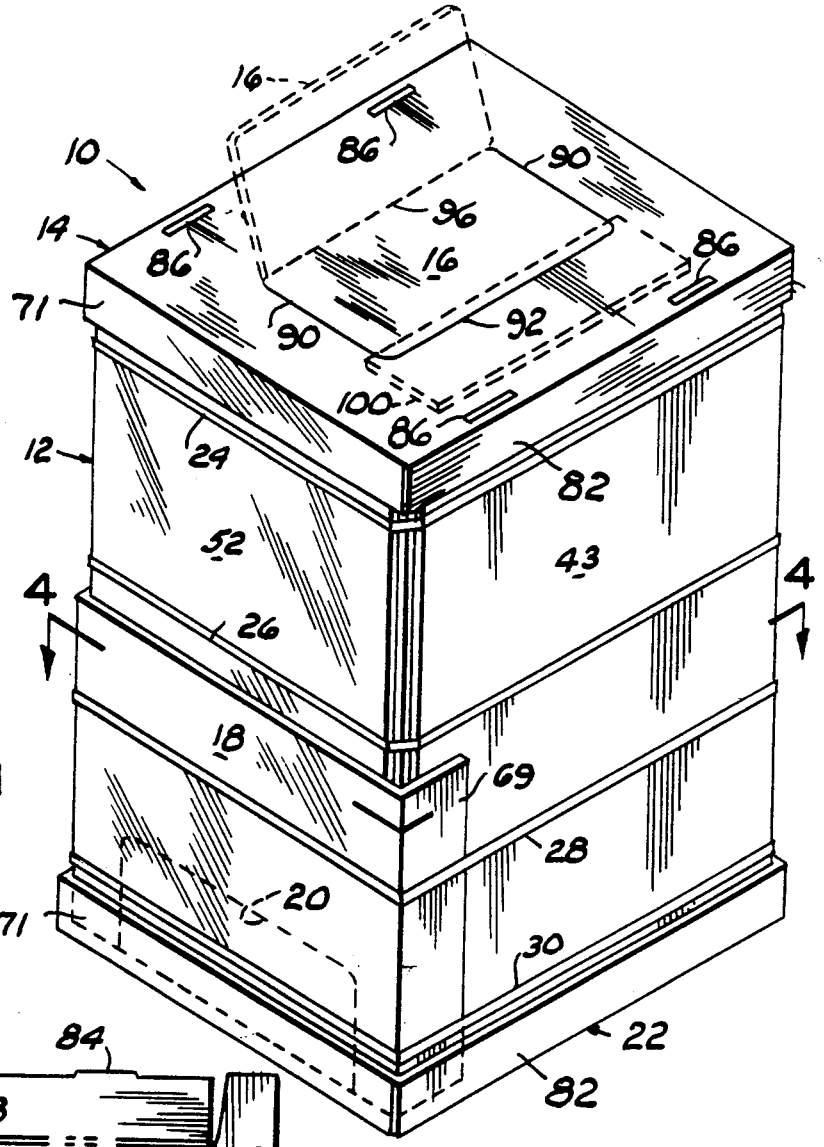
FIG. 1 is an isometric view of the container illustrating, by dotted lines, the top access door in open position.
Figure 3:
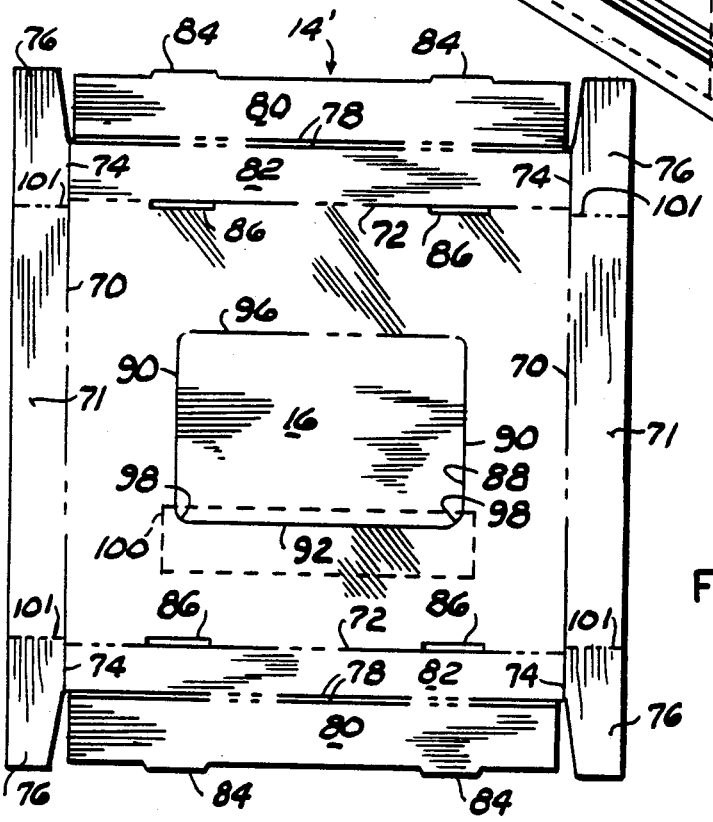
FIG. 3 is a pattern view of the container end caps.
Figure 2:
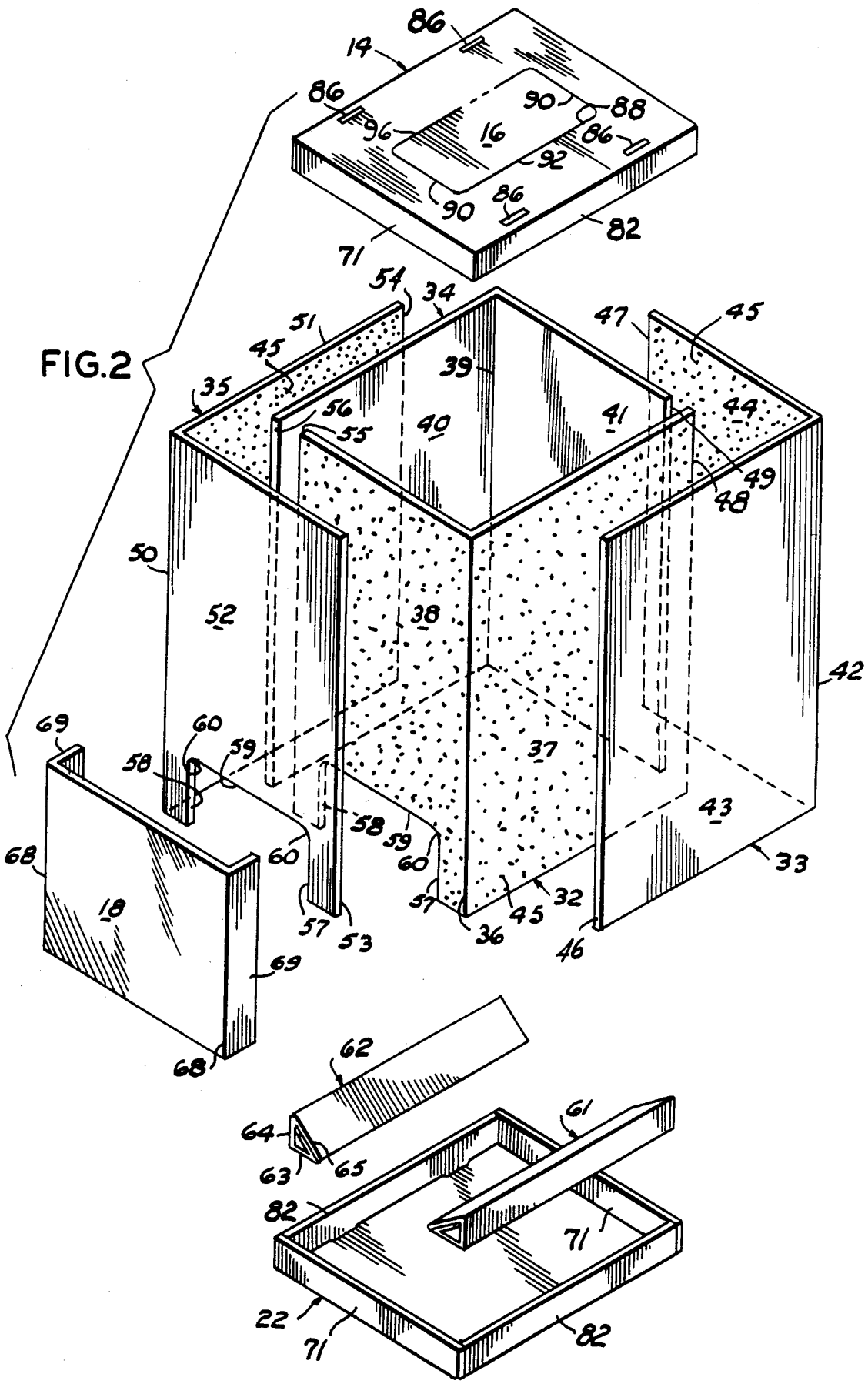
FIG. 2 is an exploded isometric view, to a smaller scale, of the container components.

Like characters of reference designate like parts in those figures of the drawings in which they occur.

In the drawings:

Referring more particularly to FIGS. 1 to 4, the reference numeral 10 indicates the container, preferably formed from relatively lightweight double wall panel material, such as corrugated board, which is rectangular upright in general configuration and is normally supported by a conventional pallet, not shown, underlying its depending end. The container 10 comprises a double wall open end sleeve 12 having its upper end closed by a top cap 14 having side and end panels, as presently described, overlapping the sleeve walls and having an access door 16, a door cover 18 closing a discharge door opening 20 and a bottom tray or cap 22 similarly closing the bottom end of the sleeve and overlapping the depending portion of the sleeve walls and door cover 18. The sleeve 12, including the door cover 18, is surrounded by a plurality of vertically spaced straps 24, 26, 28 and 30.

The sleeve 12 is formed by a pair of double wall rectangular inner panels 32 and 34 and a pair of double wall outer panels 33 and 35. The panel 32 is folded, at right angle, along the vertical fold line 36 to define one side wall 37 and a front end wall 38, respectively.

The panel 34 is similarly folded at right angle along the vertical fold line 39 to define an outer side wall 40 parallel with and opposite the side wall 37 and a rear wall 41 parallel with and opposite the front end panel 38.

The panel 33 is folded at right angle along the vertical fold line 42 to form a sleeve outer side wall panel 43 for overlapping the sleeve inner side wall panel 37 and a sleeve outer end wall panel 44 for overlapping the sleeve inner end wall panel 41. The inner and outer side wall panels 37 and 43 are bonded together by a suitable bonding agent, indicated at 45, in flat contiguous contact with the free edge surface 46 of the panel 43 in selected spaced relation with respect to the fold line 36 of the panel 32 for the purpose presently explained.

Figure 4:
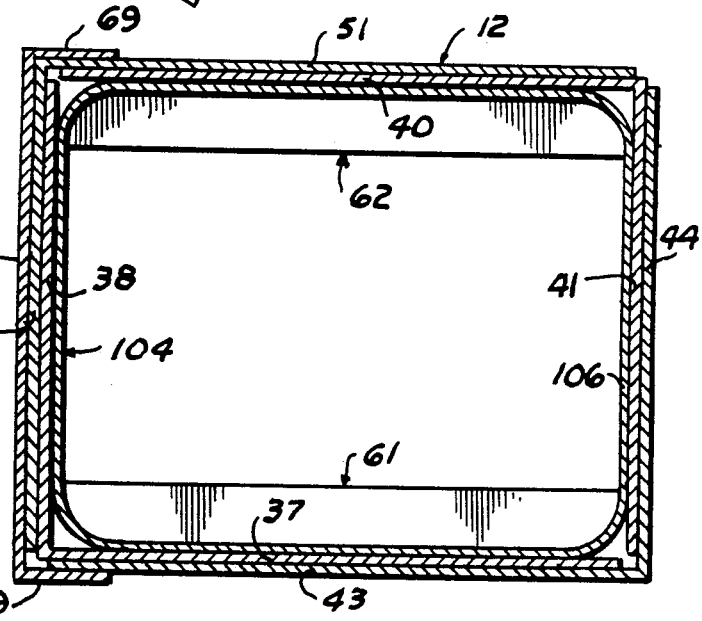
FIG. 4 is a horizontal sectional view taken substantially along the line 4—4 of FIG. 1 with the bottom cap removed; and, FIG. 5 is a view similar to FIG. 1, partially in section, illustrating the container dispensing door in opened position and a cap panel severed from the bottom cap and shown by dotted lines.

The sleeve end panels 41 and 44 are similarly bonded together by the adhesive 45 with the free edge 47 of the outer panel 44 disposed in similar selected spaced relation with respect to the fold line 39 of the inner panel 34. Similarly, the free edge surfaces 48 and 49 of the inner panels 37 and 41, respectively, are disposed in similar selected spaced-apart relation with respect to the fold line 42 of the outer panel 33. Similarly, the outer panel 35 is folded along the vertical fold line 50 to define a sleeve side wall panel 51 parallel with the inner panel wall 40 and an end panel 52 parallel with the inner panel end wall 38. The panels 51 and 52 are flatly bonded by the adhesive 45 to the side and end panels 40 and 38, respectively, with the free vertical edges 53 and 54 of the panel 35 similarly disposed in spaced relation with respect to the panel folds 36 and 39, respectively. Similarly the inner panel free edges 48 and 49 and 55 and 56 are disposed in spaced relation with respect to the outer panel lines 42 and 50, respectively. The purpose of the spacing, preferably substantially equal to the double wall thickness of the panels, between the outer and inner panels free edges with respect to the adjacent vertical fold lines, as best illustrated in FIG. 4, is for providing folding space in the respective corner areas of the sleeve. The sleeve is folded flat by forcing the inner surface of the inner panels toward each other in a manner common with cardboard boxes in which the sleeve panels pivot with respect to each other about the vertical fold lines.

Collapsing the sleeve 12 is for the purpose of storing and shipping the containers and is particularly useful for returning the containers to the point of origin of goods shipped therein after delivery of several of the filled containers.

The discharge or door opening 20 is centrally formed through the depending end portion of the sleeve walls 38 and 52 and is defined by laterally spaced-apart vertical edge surfaces 57 and 58 to define the sides of the opening and a top horizontal downwardly facing edge 59 with the juncture of the edge 52 with the vertical edges 57 and 58 being formed on a selected radii, as at 60, for the purpose of preventing failure of the front walls 38 and 52, as more fully explained hereinbelow.

The door cover 18 is similarly formed from a section of corrugated board and extends transversely of the sleeve wall 38 and upwardly from its depending limit to a position spaced above the upper limit of the door opening 20. Respective end portions of the door cover are folded along vertical fold lines 68 to form door cover panels 69 overlapping the adjacent portion of the respective sleeve walls 43 and 51.

Filler blocks 61 and 62 are placed in the sleeve adjacent the depending end of the inner side walls 37 and 40 for the purpose of discharging finely ground bulk material from the sleeve which would ordinarily compact and remain in the sleeve when discharging its contents. Since the filler blocks are mirror images of each other, only the block 62 will be described in detail. The block 62 is formed by a length of the corrugated board equal to the inside dimension of the sleeve between its end walls. The board is folded along longitudinal score lines to define a right triangle, in end view, with the length of the base 63 being substantially equal to the spacing between the door opening vertical edge 58 and the inner surface of the side wall 40. The dimension of the triangle altitude side 64 is substantially equal with the dimension of its base 63. Respective opposing longitudinal edge portions of the panel forming the block 62 form a double layer hypotenuse 65.

The top cap 14 is formed from a rectangular corrugated board blank 14' in which fold lines are indicated by phantom lines. Fold lines 70 are scored parallel with and spaced inwardly of the respective longitudinal sides of the blank to define cap end panels 71. Inwardly of its respective sides, the blank is transversely scored to form fold lines 72 extending between the fold lines 70 and defining a rectangular panel equal in area to the area encompassed by the open end of the sleeve 12. The blank 14' is cut or slit, as at 74, inwardly from each of its sides along the fold lines 70 terminating at the juncture with the fold lines 72 to define corner flaps 76. Each side portion of the blank 14', between its respective side and the respective fold line 72 is transversely scored by a pair of closely spaced fold lines 78 to define cap side panels 80 and 82, for the purpose presently explained.

A transverse portion of each side edge of the blank 14' is cut away to define a pair of locking tabs 84. Rectangular apertures 86 are cut through the material of the blank adjacent the fold lines 72 in cooperative alignment with and for receiving the tabs 84. The blank 14' is further provided with an access door or container filler opening 88 defined by cutting through the material of the blank along three sides of the opening, as shown by the lines 90, parallel with the fold lines 70 and the line 92 parallel with the fold lines 72 thus forming the door flap 16 which hinges to an open and closed position along the phantom line 96. The access opening is also characterized by forming a radius 98 at the juncture of the lines 90 with the line 92 and the lines 90 at their juncture with the fold line 96.

An access door stop 100 comprises a rectangular section of material bonded to the depending surface of the top cap in a manner to underlap the free edge portion of the access door flap 16 opposite its hinge or bend line 96 for the purpose of maintaining the access door flap 16 in the plane of the top cap when in closed position.

The top cap is assembled by bending or folding the opposing end panels 71 cooperatively inward at right angle to the plane of the blank 14' along the fold lines 70 and folding each of the flaps 76 at right angle along the fold lines 101 to extend transversely of the blank 14' in confronting relation. The cap end panels 80 and 72 are then folded inwardly at right angle as a unit along the fold lines 72 to dispose the respective end panel 82 adjacent the respective flap 76. The end panel 80 is then folded along the fold lines 78 to enclose the flaps 76 between the end panels 80 and 82 with the locking flaps 84 entering the respective apertures 86.

The bottom cap 22 is formed and folded identical with respect to the top cap 14 with the exception the access opening 88 and door flap 16 are omitted.

OPERATION

When used for storing and shipping bulk edible food stuffs, such as rice, sugar, flour, or the like, the container is provided with a plastic bag 104 containing the material to prevent contamination thereof.

The plastic bag 104 is formed from relatively heavy gauge material, for example 6 mil, with the bag having a diameter such that when placed within the sleeve 12 and filled with granular or powdered material the wall 106 of the bag flatly contacts the inner wall surfaces of the sleeve and subtends the respective vertically disposed right angular corner (FIG. 4) thus relieving excessive pressure on the container wall material at the respective corner of the sleeve.

Figure 5:
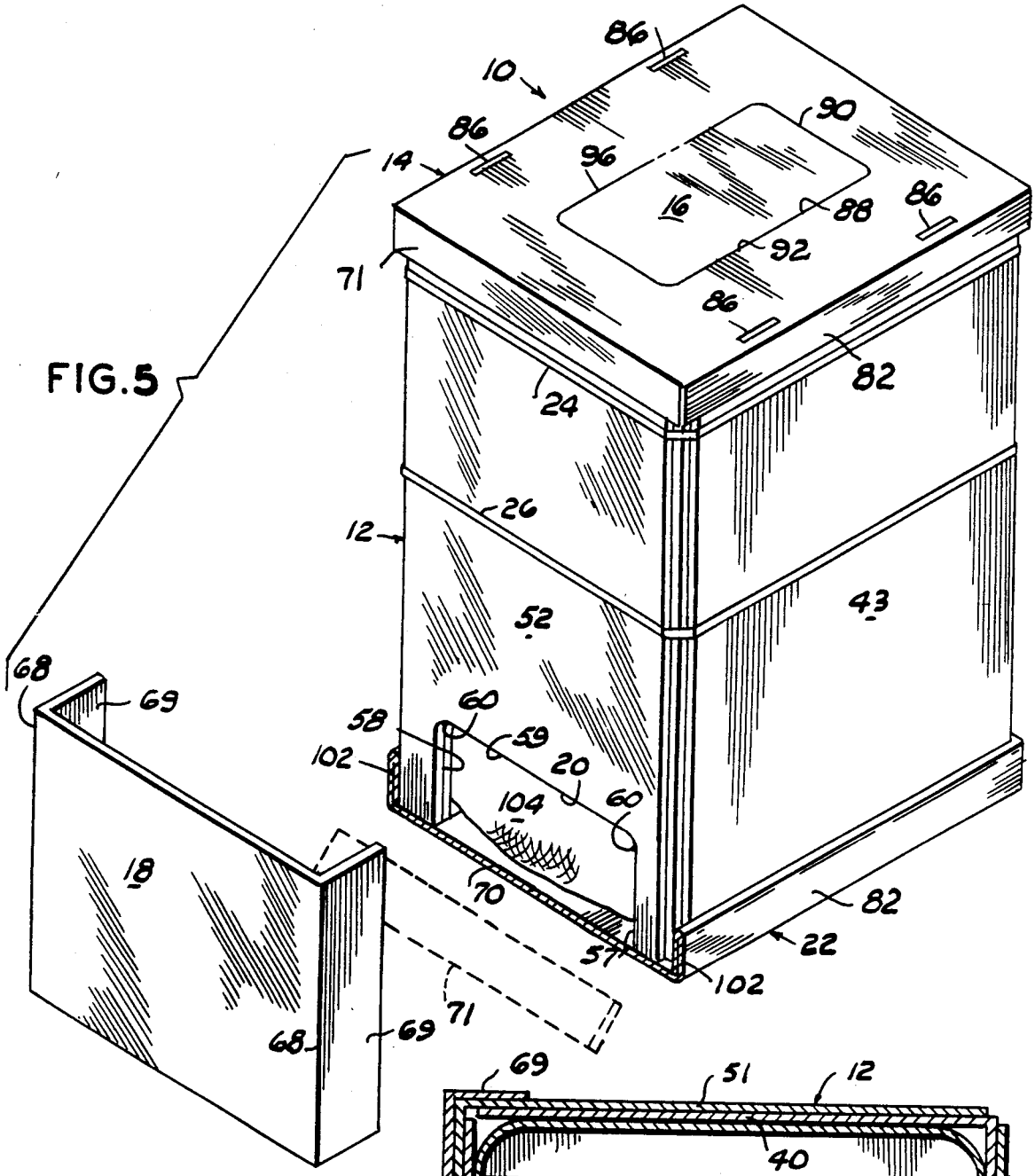

Referring also to FIG. 5, the container 10 is emptied by cutting or otherwise removing the straps 28 and 30. The bottom cap panel 71, overlapping the depending portion of the door cover 18, is turned outwardly and downwardy by first cutting through the end flaps 76 along their fold lines 101, as indicated by the cross hatch lines 102. The door cover 18 is then manually removed from contact with the sleeve 12, as by moving it laterally of the sleeve wall 52, thus exposing the door opening 20 and the surface of the bag 104 containing the bulk material, not shown. The panel 71 is then separated from the bottom cap by cutting along the fold line 70. It is at this point that the door dispensing opening radius surfaces 60 function to prevent a rupture of the sleeve walls 38 and 52 by the stress placed on the edge surfaces defining the dispensing door opening 20 as a result of the mass of the bulk material tending to flow by gravity outwardly through the opening. The entire container is then lifted and angularly tilted toward its door opening, as by a forklift not shown, to dispose the outer surface of the sleeve wall 52, surrounding the door opening 20, in contact with the intake throat of an air operated material handling system, not shown. After tilting the container, the bulk material bag 104 is cut or torn the full width of the dispensing door opening 20 so that all material within the container may be removed through the door opening 20.

After emptying, the container is normally collapsed for storage and, if shipped, the end caps are discarded. If the container is reused at the point of material delivery, the door cover 18 is repositioned on the sleeve 12 to close the door opening 20 and a new bottom cap 22 installed, as previously described. Similarly, new bands 28 and 30 are placed around the sleeve and door cover, as shown by FIG. 1.

Obviously the invention is susceptible to changes or alterations without defeating its practicability. Therefore, I do not wish to be confined to the preferred embodiment shown in the drawings and described herein.

I claim:

1. A bulk material container, comprising:

a normally upright multiple wall thickness sleeve formed by a pair of double wall thickness inner panels and a pair of double wall thickness outer panels defining sleeve side and end walls, each pair of panels of said pairs of inner panels and outer panels comprising a side panel and an end panel integrally joined together along a vertical fold line with each panel having a respective vertical free edge surface opposite the fold line, said side and end panels of each pair of inner panels being contiguously bonded flatly to corresponding side and end panels of said pair of outer panels with one of the free vertical edge surfaces of said pair of inner panels and said pair of outer panels disposed in parallel spaced-apart relation to others of the free vertical edge surfaces of said pair of inner panels and said pair of outer panels respectively a distance substantially equal to the wall thickness of the respective side or end panel of said inner and outer pairs of panels, one said sleeve wall having a cutout in its lower edge portion forming a door dispensing opening;

a bottom cap having a bottom panel with upstanding corresponding side and end panels connected thereto along bottom fold lines and disposed in adjacent overlying relation on the sleeve side and end walls;

a door cover spanning the door opening and overlapping the outer surface of the depending end portion of said one sleeve wall around the door opening therein; and, at least one strap normally surrounding said sleeve and said door cover, said door cover being moveable, as a unit, laterally of said one sleeve wall for uncovering the door opening upon removal of said strap, whereby said sleeve may be flatly collapsed after removal of said strap and said bottom cap.

2. The container according to claim 1 and further including:

filler block means in said sleeve and contacting the sleeve walls, normal to the plane of the wall having the door opening, at their intersection with said bottom panel for insuring emptying the container of all powdered bulk material when said door cover is removed.

3. The container according to claim 2 in which the door opening cutout is defined by spaced-apart confronting vertical surfaces each terminating at their upper limit in a radius merging with a downwardly facing horizontal surface.

4. The container according to claim 3 and further including:

a top cap having a top panel with depending side and end panels connected thereto along top fold lines and disposed in adjacent cooperating overlapping relation on the sleeve side and end walls; and, an access opening formed by an access door flap struck out of the top panel opening and closing the access opening.

* * * * *